US011546688B2

(12) United States Patent
Tian et al.

(10) Patent No.: US 11,546,688 B2
(45) Date of Patent: Jan. 3, 2023

(54) LOUDSPEAKER DEVICE, METHOD, APPARATUS AND DEVICE FOR ADJUSTING SOUND EFFECT THEREOF, AND MEDIUM

(71) Applicant: GOERTEK INC., Shandong (CN)

(72) Inventors: Huaiqing Tian, Shandong (CN); Xiaojiao Zhang, Shandong (CN); Ke Dong, Shandong (CN)

(73) Assignee: GOERTEK INC., Weifang (CN)

( * ) Notice: Subject to any disclaimer, the term of this patent is extended or adjusted under 35 U.S.C. 154(b) by 0 days.

(21) Appl. No.: 17/287,198

(22) PCT Filed: Dec. 29, 2018

(86) PCT No.: PCT/CN2018/125231

§ 371 (c)(1),
(2) Date: Apr. 21, 2021

(87) PCT Pub. No.: WO2020/087746

PCT Pub. Date: May 7, 2020

(65) Prior Publication Data

US 2021/0392433 A1 Dec. 16, 2021

(30) Foreign Application Priority Data

Oct. 29, 2018 (CN) ..... 201811267871.4

(51) Int. Cl.
*H04R 1/40* (2006.01)

(52) U.S. Cl.
CPC ..... *H04R 1/403* (2013.01); *H04R 1/406* (2013.01)

(58) Field of Classification Search
CPC ..... H04R 1/403; H04R 1/406; H04S 7/30; H04S 7/301; H04S 7/302; H04S 7/303
See application file for complete search history.

(56) References Cited

U.S. PATENT DOCUMENTS

2005/0075875 A1 4/2005 Shozakai
2013/0314857 A1* 11/2013 Ohnishi ..... G11B 17/0405 361/679.01

(Continued)

FOREIGN PATENT DOCUMENTS

CN 104517621 4/2015
CN 104750051 7/2015

(Continued)

OTHER PUBLICATIONS

International Search Report issued in PCT/CN2018/125231 dated Jul. 26, 2019.

*Primary Examiner* — Jason R Kurr
(74) *Attorney, Agent, or Firm* — Workman Nydegger

(57) ABSTRACT

The present application relates to the technical field of loudspeakers. Disclosed are a loudspeaker device, a method, apparatus and device for adjusting the sound effect thereof, and a medium. The method is used for increasing the diversity of the sound effect of the loudspeaker device, and comprises: determining the spatial distribution state of multiple loudspeaker units in the loudspeaker device; determining a sound effect mode corresponding to the spatial distribution state; and adjusting the sound effect of the loudspeaker device according to the sound effect mode. According to the present application, the sound effect mode is accordingly adjusted according to the spatial distribution state of multiple loudspeaker units in the loudspeaker device. In this way, when the spatial distribution state changes, the sound effect mode of the loudspeaker device also changes, thereby overcoming the defect of the single sound effect of the loudspeaker device, i.e., according to the present application, the diversity of the sound effect of the loudspeaker device can be increased efficiently.

19 Claims, 9 Drawing Sheets

(56) References Cited

U.S. PATENT DOCUMENTS

| | | | | |
|---|---|---|---|---|
| 2015/0104050 | A1* | 4/2015 | Harrison | H04S 7/301 381/303 |
| 2016/0189728 | A1 | 6/2016 | Chen et al. | |
| 2017/0195815 | A1* | 7/2017 | Christoph | H04S 7/301 |
| 2017/0201847 | A1* | 7/2017 | Fujita | G01B 11/00 |
| 2017/0257689 | A1* | 9/2017 | Milne | H04S 7/302 |
| 2017/0295426 | A1* | 10/2017 | Park | H04R 5/02 |
| 2019/0246229 | A1* | 8/2019 | Wardle | H04S 7/305 |

FOREIGN PATENT DOCUMENTS

| | | |
|---|---|---|
| CN | 104936125 | 9/2015 |
| CN | 104967953 | 10/2015 |
| CN | 106028226 | 10/2016 |
| CN | 106325808 | 1/2017 |
| CN | 106817657 | 6/2017 |
| CN | 107392094 | 11/2017 |
| TW | I265746 | 11/2006 |

* cited by examiner

LOUDSPEAKER DEVICE, METHOD, APPARATUS AND DEVICE FOR ADJUSTING SOUND EFFECT THEREOF, AND MEDIUM

This application is the U.S. national phase of International Application No. PCT/CN2018/125231, titled "LOUDSPEAKER DEVICE, METHOD, APPARATUS AND DEVICE FOR ADJUSTING SOUND EFFECT THEREOF, AND MEDIUM", filed on Dec. 29, 2018, which claims priority of Chinese Patent Application No. 201811267871.4, titled "LOUDSPEAKER DEVICE, METHOD, APPARATUS AND DEVICE FOR ADJUSTING SOUND EFFECT THEREOF, AND MEDIUM", filed with the China National Intellectual Property Administration on Oct. 29, 2018, both of which are incorporated herein by reference in their entirety.

FIELD

The present application relates to the technical field of sounds, and in particular to a sound equipment, a method, an apparatus and a device for adjusting a sound effect thereof, and a medium.

BACKGROUND

At present, sound equipment is a very common consumer electronic product in residential homes, which is also an important part of a home theater. However, the sound effect of traditional sound equipment is relatively monotonous, which on the one hand cannot meet the need of a user for different sound effects, and on the other hand will cause auditory fatigue to a user if the user listens to the same sound effect for a long time. Therefore, an issue to be addressed presently is to increase the diversity of sound effects of the sound equipment.

SUMMARY

In view of this, a sound equipment, a method, an apparatus, a device for adjusting a sound effect thereof, and a medium are provided according to the present application, which can effectively increase the diversity of sound effects of the sound equipment. The specific solutions are as follows.

In the first aspect, a sound effect adjustment method is provided according to the present application, which is applied to a sound equipment including multiple loudspeaker units, the method including:

- determining a spatial distribution state of the multiple loudspeaker units;
- determining a sound effect mode corresponding to the spatial distribution state; and
- adjusting a sound effect of the sound equipment according to the sound effect mode.

In the second aspect, a sound effect adjustment apparatus is provided according to the present application, which is applied to a sound equipment including multiple loudspeaker units, the apparatus including:

- a state information determination module configured to determine a spatial distribution state of the multiple loudspeaker units;
- a sound effect mode determination module configured to determine a sound effect mode corresponding to the spatial distribution state; and

- a sound effect adjustment module configured to adjust a sound effect of the sound equipment according to the sound effect mode.

In the third aspect, a sound effect adjustment device is provided according to the present application, including:

- a memory configured to store a computer program;
- a processor configured to execute the computer program to perform the sound effect adjustment method described above.

In the fourth aspect, a sound equipment is provided according to the present application, including multiple loudspeaker units, and further including the sound effect adjustment device described above.

In the fifth aspect, a computer-readable storage medium is provided according to the present application, which is configured to store a computer program, where the computer program is executable by a processor to perform the sound effect adjustment method described above.

It can be seen that the sound effect adjustment solution of the present application is applied to a sound equipment including multiple loudspeaker units. A spatial distribution state of the multiple loudspeaker units is determined first, a sound effect mode corresponding to the spatial distribution state is subsequently determined, and the sound equipment is adjusted afterwards according to the sound effect mode. That is, in the present application, the sound effect mode may be correspondingly adjusted according to the spatial distribution state of the multiple loudspeaker units in the sound equipment. In this way, when the spatial distribution state changes, the sound effect mode of the sound equipment may also be changed accordingly, which overcomes the disadvantage of monotonous sound effect of sound equipment. In summary, the present application can effectively increase the diversity of sound effects of sound equipment.

BRIEF DESCRIPTION OF THE DRAWINGS

For more clearly illustrating embodiments of the present application or the technical solutions in the conventional technology, drawings referred to for describing the embodiments or the conventional technology will be briefly described hereinafter. Apparently, drawings in the following description are only examples of the present application, and for the person skilled in the art, other drawings may be obtained based on the set drawings without any creative efforts.

DETAILED DESCRIPTION OF THE EMBODIMENTS

The technical solutions according to the embodiments of the present application will be described clearly and completely as follows in conjunction with the drawings in the embodiments of the present application. It is apparent that the described embodiments are only a part of the embodiments according to the present application, rather than all of the embodiments. Based on the embodiments of the present application, all other embodiments obtained without creative efforts by those of ordinary skill in the art shall fall within the protection scope of the present application.

Since the sound effect of traditional sound equipment is relatively monotonous, which cannot meet the needs of a user for different sound effects, and will easily cause auditory fatigue to the user. Therefore, a technical solution for adjusting a sound effect based on a spatial distribution state of multiple loudspeaker units is proposed according to the present application, which overcomes the disadvantage of monotonous sound effect of the sound equipment and increases the diversity of the sound effect of the sound equipment.

Figure 1:
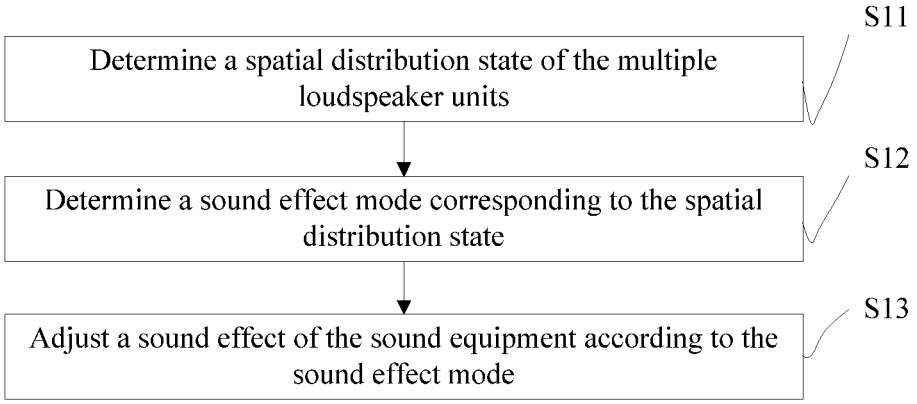
FIG. 1 is a flow chart of a sound effect adjustment method according to the present application.

As shown in FIG. 1, a sound effect adjustment method is provided according to the present application, which is applied to a sound equipment including multiple loudspeaker units, the method including steps S11 to S13.

Step S11 includes determining a spatial distribution state of the multiple loudspeaker units;

In the embodiment, a spatial distribution state of the multiple loudspeaker units may include corresponding direction information when the loudspeaker units are spatially distributed, and may further include corresponding distance values when the loudspeaker units are spatially distributed. In addition, in this embodiment, a sound intensity collected by a microphone can be used to determine a spatial distribution state of the multiple loudspeaker units, and image information collected by a camera can also be used to determine the spatial distribution state of the multiple loudspeaker units. In practice, positioning information collected by a positioning apparatus based on an indoor positioning technology can also be used to determine the spatial distribution state of the multiple loudspeaker units.

It should be pointed out that the multiple loudspeaker units may be all loudspeaker units in a sound equipment, or some of all the loudspeaker units in the sound equipment. It is understandable that if the multiple loudspeaker units are some of all the loudspeaker units, before the step S11, it is also necessary to determine the multiple loudspeaker units from all the loudspeaker units.

In a specific implementation, a distance value of each loudspeaker unit relative to a reference target may be determined first, and then loudspeaker units with a distance value greater than a preset distance threshold are eliminated from all the loudspeaker units, and remaining loudspeaker units are determined as the multiple loudspeaker units. It should be noted that the reference target may be a listening subject such as a child, a youngster, a middle-aged person, or an old person; or it may be a preset apparatus, where the preset apparatus may be an apparatus of the sound equipment, such as a control unit in the sound equipment, or an apparatus which is designated by a user through a preset client and independent of the sound equipment. In addition, the preset distance threshold may be manually set by the user through the preset client, or may be automatically set by the sound equipment in advance. Specifically, the sound equipment may first determine a space size of a spatial environment where it is currently located, and then automatically determine the preset distance threshold whose numerical value is positively correlated with the space size. The sound equipment may estimate the space size of the spatial environment where it is located, based on methods such as light wave ranging, sound wave ranging, image depth information detection, or may obtain the space size by manually inputted information.

In another specific implementation, some loudspeaker units may be manually selected from all loudspeaker units to obtain the multiple loudspeaker units. Specifically, a user may select some loudspeaker units from all loudspeaker units through the preset client to serve as the multiple loudspeaker units.

It is understandable that the preset client in the embodiment may be a client built in the sound equipment, or a client on a handheld smart terminal such as a mobile phone or a tablet computer.

In addition, it should be pointed out that in step S11, the spatial distribution state of multiple loudspeaker units may specifically be a spatial distribution state of each loudspeaker unit relative to a reference target, or a spatial distribution state of each loudspeaker unit relative to other loudspeaker units. The reference target includes the listening subject or the preset apparatus.

Step S12 includes determining a sound effect mode corresponding to the spatial distribution state.

In the embodiment, there is a correspondence relationship between sound effect modes of the sound equipment and spatial distribution states of the multiple loudspeaker units. It can be understood that different spatial distribution states of the multiple loudspeaker units usually correspond to different degrees of spatial dispersion. In the embodiment, a spatial sense of the finally determined sound effect mode is preferentially in positive correlation with the degree of spatial dispersion corresponding to the spatial distribution state, that is, the greater the degree of spatial dispersion is, the stronger the spatial sense of the sound effect mode is. In this way, the spatial distribution state of the multiple loudspeaker units can be adjusted according to a preference of the user for spatial sense of a sound effect, so as to achieve the purpose of adjusting the sound effect mode of the sound equipment to a mode preferred by the user.

In a specific implementation, the spatial distribution state of multiple loudspeaker units may be adjusted manually.

Specifically, a user may change the spatial distribution state by moving the multiple loudspeaker units or the preset apparatus.

In another specific implementation, the spatial distribution state may also be changed by controlling the loudspeaker units or the preset apparatus to slide on a preset slide rail. Specifically, in the embodiment, a sliding control rule may be preset, where the sliding control rule includes a sliding trigger time and a corresponding expected spatial distribution state. When the current time matches the sliding trigger time preset in the sliding control rule, the loudspeaker units or the preset apparatus is automatically controlled to slide on the preset slide rail, so that the multiple loudspeaker units form a corresponding spatial distribution state. For example, spatial distribution states corresponding to morning, noon and evening may be respectively recorded in the sliding control rule. If the current time is in the morning, the spatial distribution state corresponding to the morning can be found from the sliding control rule, and the loudspeaker units or the preset apparatus may be controlled to perform a corresponding sliding operation; in the same way, if the current time is in the night, the spatial distribution state corresponding to the night can be found from the sliding control rule, and the loudspeaker units or the preset apparatus may be controlled to perform a corresponding sliding operation. In this way, different needs of users for sound effects at different times can be met, and user experience can be improved. In the embodiment, the sliding control rule may be set independently by the user.

Step S13 includes adjusting a sound effect of the sound equipment according to the sound effect mode.

Specifically, in the embodiment, after a corresponding sound effect mode is determined through the step S12, a corresponding working parameter of each of the multiple loudspeaker units can be determined according to the sound effect mode, and each of the loudspeaker units is controlled into a corresponding working state according to the working parameter to form the sound effect mode.

In a specific implementation, the adjusting a sound effect of the sound equipment according to the sound effect mode may specifically include: adjusting automatically and directly the sound effect of the sound equipment according to the sound effect mode. That is, in the embodiment, after the sound effect mode is determined through the step S12, the sound effect of the sound equipment may be directly and automatically adjusted according to the sound effect mode, which is a full automatic processing process without user intervention, improving the degree of intelligence and automation of the sound effect adjustment solution.

In another specific implementation, the adjusting a sound effect of the sound equipment according to the sound effect mode may specifically include: monitoring whether an adjustment instruction sent by the preset client is obtained, and if an adjustment instruction is obtained, adjusting the sound effect of the sound equipment according to the sound effect mode. That is, in the embodiment, after the sound effect mode is determined through the step S12, it is necessary to further monitor whether an adjustment instruction sent by the preset client is obtained. If the adjustment instruction is detected, the sound effect may be adjusted according to the sound effect mode. If the adjustment instruction is not detected, the sound effect will not be adjusted. That is, in the embodiment, after the sound effect mode is determined, the sound effect adjustment process is not directly performed. Rather, the sound effect adjustment processing is performed according to the sound effect mode, only after an adjustment instruction is triggered and sent to the sound equipment by a user through the preset client, and is obtained by the sound equipment. This process requires user intervention, which increases the participation degree of the user and beneficial to improving the user experience.

It can be seen that the sound effect adjustment solution of the present application is applied to a sound equipment including multiple loudspeaker units. A spatial distribution state of the multiple loudspeaker units is determined first, a sound effect mode corresponding to the spatial distribution state is subsequently determined, and the sound equipment is adjusted afterwards according to the sound effect mode. That is, in the present application, the sound effect mode may be correspondingly adjusted according to the spatial distribution state of the multiple loudspeaker units in the sound equipment. In this way, after the spatial distribution state changes, the sound effect mode of the sound equipment may also be changed accordingly, which overcomes the disadvantage of monotonous sound effect of sound equipment. In summary, the embodiment of the present application may effectively increase the diversity of sound effects of sound equipment.

Figure 2:
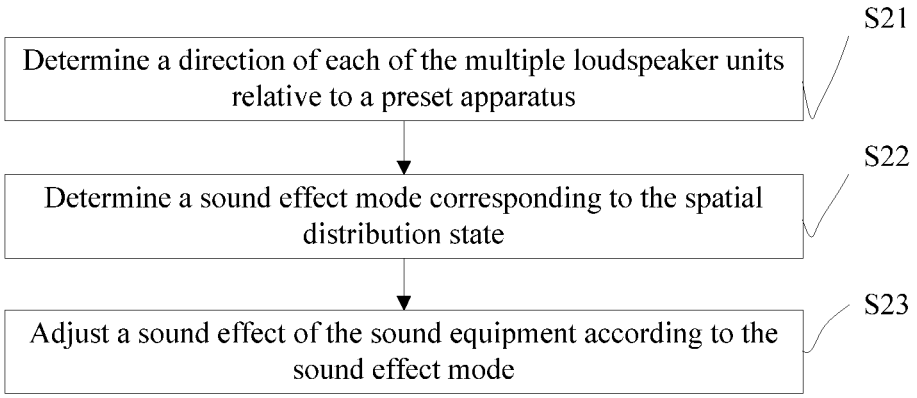
FIG. 2 is a flowchart of a specific sound effect adjustment method according to the present application.

As shown in FIG. 2, a sound effect adjustment method is provided according to the present application, which is applied to a sound equipment including multiple loudspeaker units, the method including steps S21 to S23.

Step S21 includes determining a direction of each of the multiple loudspeaker units relative to a preset apparatus.

In the first specific implementation, multiple sound intensities corresponding to each of the multiple loudspeaker units may be determined through multiple microphones installed on the preset apparatus, and the direction of each of the multiple loudspeaker units relative to the preset apparatus may be correspondingly determined according to the multiple sound intensities corresponding to each of the multiple loudspeaker units. That is, in the embodiment, multiple microphones may be preinstalled on the preset apparatus. In determining the direction of each of the multiple loudspeaker units relative to the preset apparatus, different loudspeaker units are controlled to play a preset audio at different time instants, and the multiple sound intensities corresponding to each of the multiple loudspeaker units are collected through the multiple microphones when the loudspeaker unit plays the preset audio. It can be understood that different microphones in the embodiment have different installation positions, that is, orientations of different microphones relative to the same loudspeaker unit are different. Therefore, the multiple sound intensities corresponding to each of the multiple loudspeaker units collected through the multiple microphones are also different. The direction of each of the multiple loudspeaker units relative to where the multiple microphones are located, that is, the direction of each of the multiple loudspeaker units relative to the preset apparatus, may be determined by analyzing a difference between the multiple sound intensities corresponding to each of the multiple loudspeaker units. It can be understood that the larger the number of the multiple microphones is and the more uniform the spatial distribution thereof is, the more accurate the final determined direction is.

Figure 3:
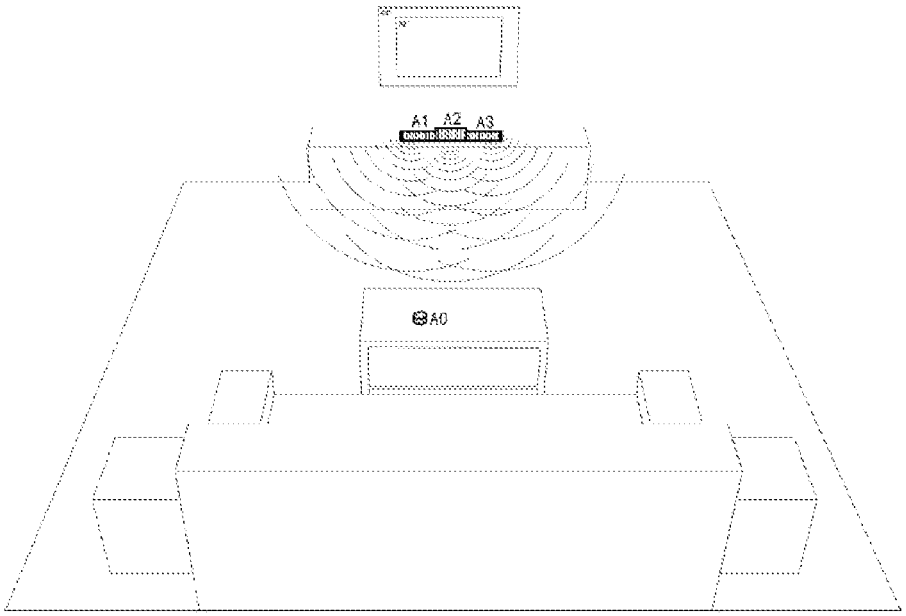
FIG. 3 is a schematic diagram of a specific application scenario of a sound equipment according to the present application.
Figure 4:
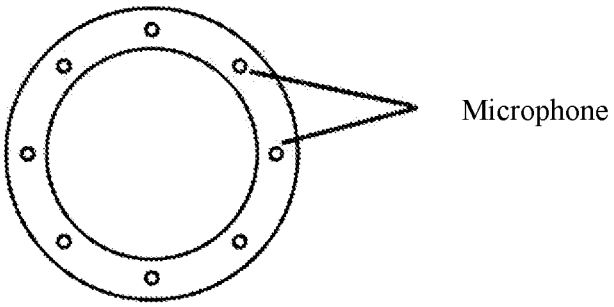
FIG. 4 is a schematic diagram of a specific microphone according to the present application.

Reference is made to FIG. 3, which shows a specific application scenario of a sound equipment. The sound equipment includes a loudspeaker unit A1, a loudspeaker unit A2 and a speaker unit A3 placed on a TV stand, and a control unit A0 placed on a tea table. A microphone ring array is pre-installed in the control unit A0. As shown in FIG. 4, the microphone ring array includes 8 microphones evenly arranged. In determining a direction of each of the multiple loudspeaker units relative to the control unit A0, the control unit A0 may control the loudspeaker units A1, A2, and A3 to play the same preset audio sequentially, for example, playing a "Beep" sound according to the same sound frequency and volume parameter, 8 sound intensities corresponding to each of the multiple loudspeaker units are respectively collected by the 8 microphones, and the direction of each of the multiple loudspeaker units relative to the control unit A0 is determined based on differences between the 8 sound intensities corresponding to each of the multiple loudspeaker units.

In the second specific implementation, image capturing is performed on a spatial environment in which the multiple loudspeaker units are located, with a first camera installed in the preset apparatus, to obtain a first panoramic image. An image region corresponding to each of the multiple loudspeaker units in the first panoramic image is identified to obtain multiple image regions, and the direction of each of the multiple loudspeaker units relative to the preset apparatus is determined according to the multiple image regions.

In the third specific implementation, a positioning apparatus based on an indoor positioning technology built in each loudspeaker unit may be used to perform spatial positioning on each loudspeaker unit to obtain positioning information of each loudspeaker unit. A positioning apparatus based on an indoor positioning technology built in the preset apparatus may be used to perform spatial positioning on the preset apparatus to obtain positioning information of the preset apparatus. Subsequently, the direction of each of the multiple loudspeaker units relative to the preset apparatus is determined according to the positioning information of the preset apparatus and the positioning information of each loudspeaker unit. In the embodiment, the indoor positioning technology includes, but is not limited to, WiFi indoor positioning technology, Bluetooth indoor positioning technology, ultra-wideband indoor positioning technology, and ZigBee indoor positioning technology.

It can be understood that the above-described are only three specific implementations of the embodiment, rather than a limitation to the embodiment. In addition to the three specific implementations, other feasible solutions may also be adopted to determine the direction of each of the multiple loudspeaker units relative to the preset apparatus, which are inconvenient to enumerate here.

Step S22 includes determining a sound effect mode corresponding to the spatial distribution state.

Figure 5:
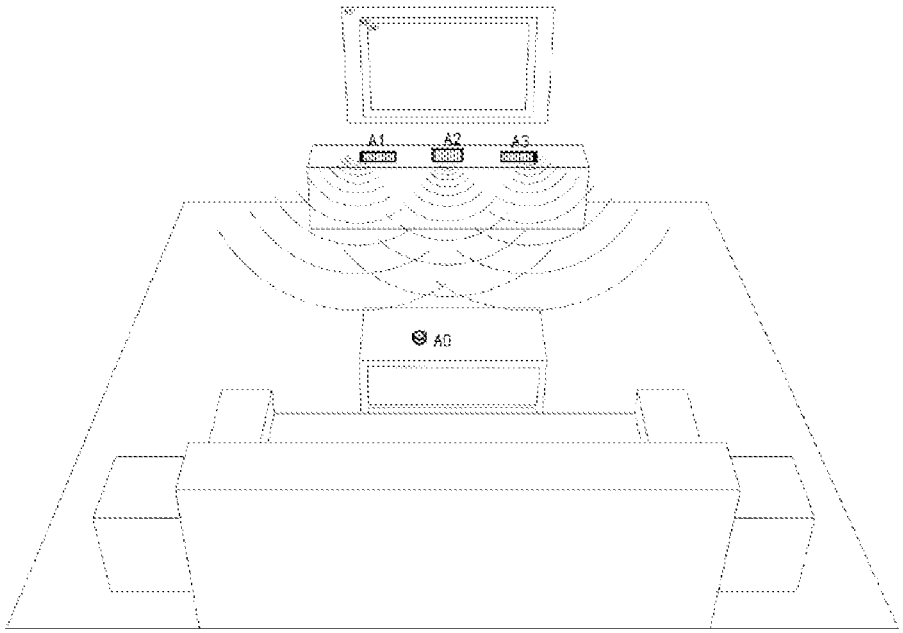
FIG. 5 is a schematic diagram of a specific application scenario of a sound equipment according to the present application.
Figure 6:
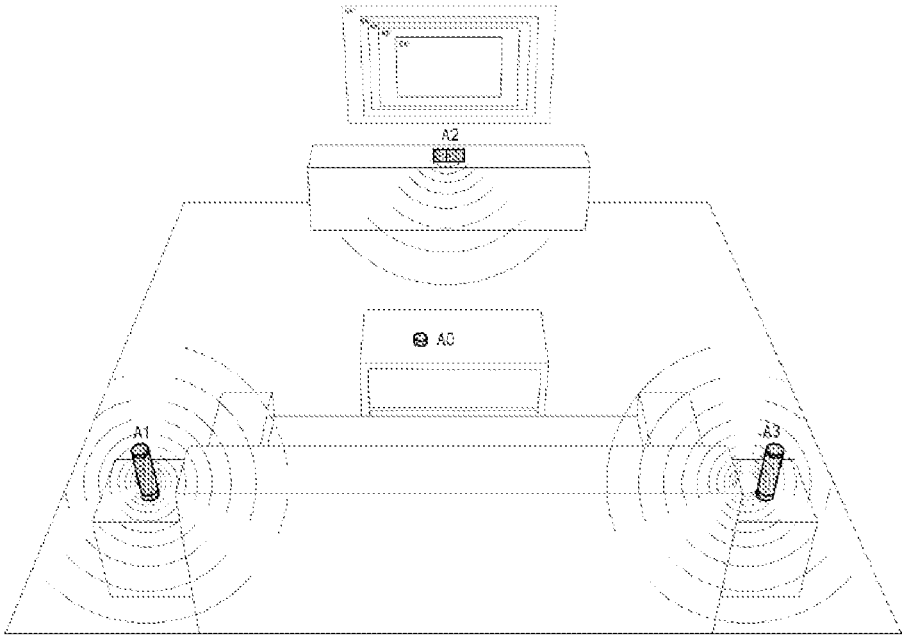
FIG. 6 is a schematic diagram of a specific application scenario of a sound equipment according to the present application.
Figure 7:
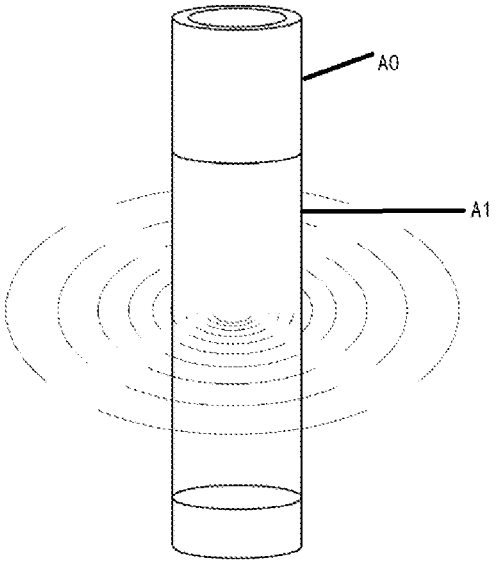
FIG. 7 is a schematic diagram of a specific application scenario of a sound equipment according to the present application.

It can be seen from FIG. 3 that the loudspeaker unit A1, the loudspeaker unit A2 and the loudspeaker unit A3 are in a combined state and are close to each other. In this case, a degree of spatial dispersion formed by the speaker unit A1, the speaker unit A2 and the speaker unit A3 is relatively low. Correspondingly, a spatial sense of the sound effect mode corresponding to the degree of spatial dispersion is relatively weak, and only a certain stereo effect needs to be ensured. In addition, besides the loudspeaker unit arrangement as shown in FIG. 3 to form a spatial distribution state of the multiple loudspeaker units, the arrangements shown in FIG. 5, FIG. 6 or FIG. 7 may also be adopted in the embodiment. The loudspeaker unit A1, loudspeaker unit A2 and loudspeaker unit A3 in FIG. 5 are still placed on a TV stand, but in a separated state rather than a combined state, which has a higher degree of spatial dispersion than the situation in FIG. 3 and hence a stronger corresponding spatial sense of sound effect; the loudspeaker unit A2 in FIG. 6 is still placed on a TV stand, but the loudspeaker unit A2 and the loudspeaker unit A3 are respectively placed on two small cabinets on both sides of a sofa, which has a higher degree of spatial dispersion than the situation in FIG. 5 and hence a stronger corresponding spatial sense of sound effect. For example, a sound effect mode corresponding to the current situation may be set as the Dolby sound effect to form a surround sound with a stronger spatial sense to meet a space requirement of a large living room. The loudspeaker unit A1 and the control unit A0 in FIG. 7 are in a combined state, and in this case, a spatial distribution state of the three loudspeaker units may be directly determined as a preset special distribution state. A spatial sense of a sound effect mode corresponding to the preset special distribution state may be a minimum value, which is theoretically zero, and when a sound effect adjustment is subsequently performed to the sound equipment based on this sound effect mode, only the loudspeaker unit A1 is controlled to play an audio, while the loudspeaker units A2 and A3 are prohibited from playing an audio, so that a spatial sense of a finally output sound effect is the minimum value. That is, in the embodiment, once it is monitored that the control unit and any loudspeaker unit are in a combined state, the spatial distribution state of the multiple loudspeaker units can be determined as the preset special distribution state, and a sound effect mode with a spatial sense of the minimum value is determined according to the preset special distribution state. In this sound effect mode, only the loudspeaker unit combined with the control unit can play an audio, while other loudspeaker units are prohibited from sounding. In the embodiment, any loudspeaker unit may be combined with the control unit through fixing methods such as magnetic attraction or snap-fit connection to form an independent intelligent loudspeaker box with a control unit, so that a user may take the independent intelligent loudspeaker box with him when he is out, or move the independent intelligent loudspeaker box from a living room to a bedroom for use.

Step S23 includes adjusting a sound effect of the sound equipment according to the sound effect mode.

For a more specific process of the steps S22 and S23, reference may be made to the corresponding content in the foregoing embodiments and the following embodiments, and details are not described herein.

Figure 8:
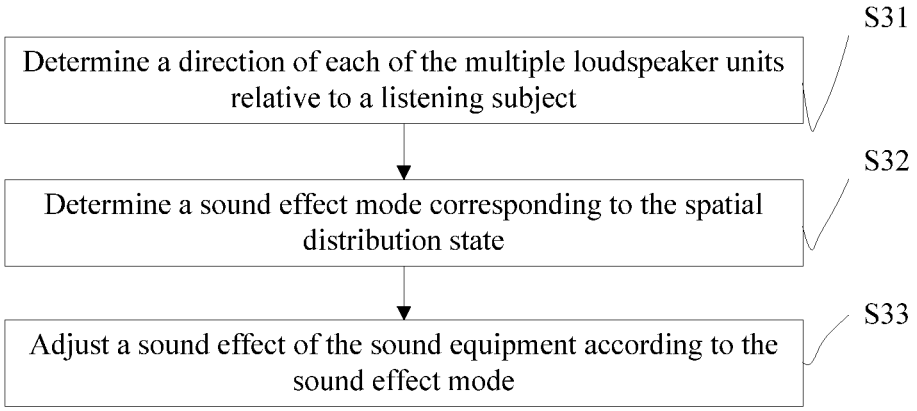
FIG. 8 is a flowchart of a specific sound effect adjustment method according to the present application.

Referring to FIG. 8, a sound effect adjustment method is provided according to the present application, which is applied to a sound equipment including multiple loudspeaker units, the method including steps S31 to S33.

Step S31 includes determining a direction of each of the multiple loudspeaker units relative to a listening subject.

In the first specific implementation, a sound intensity of a sound made by a listening subject may be collected by multiple microphones preinstalled on each loudspeaker unit, to obtain multiple sound intensities corresponding to each of the multiple loudspeaker units, and the direction of each of the multiple loudspeaker units relative to the listening subject may be determined by analyzing a difference between the multiple sound intensities corresponding to each of the multiple loudspeaker units.

In the second specific implementation, image capturing may be performed on a spatial environment in which the multiple loudspeaker units and the listening subject are located, with a second camera located above the sound equipment and the listening subject, to obtain a corresponding target image. An image region corresponding to each of the multiple loudspeaker units and an image region corresponding to the listening subject in the target image are identified, and the direction of each of the multiple loudspeaker units relative to the listening subject is determined based on the image region corresponding to each of the multiple loudspeaker units and the image region corresponding to the listening subject.

In the third specific implementation, a positioning apparatus based on an indoor positioning technology built in each loudspeaker unit may be used to perform spatial positioning on each loudspeaker unit to obtain positioning information of each loudspeaker unit, and a wearable intelligent device worn by the listening subject, which is based on an indoor positioning technology, may be used to perform spatial positioning on the listening subject to obtain positioning information of the listening subject. Subsequently, the direction of each of the multiple loudspeaker units relative to the listening subject is determined based on the positioning information corresponding to each of the multiple loudspeaker units and the positioning information corresponding to the listening subject.

It can be understood that the above-described are only three specific implementations of the embodiment, rather than a limitation to the embodiment. In addition to the three specific implementations, other feasible solutions may also be adopted to determine the direction of each of the multiple loudspeaker units relative to the listening subject, which are inconvenient to enumerate here.

In addition, in determining the direction of each of the multiple loudspeaker units relative to the listening subject, if there are multiple listening subjects in a spatial area where the sound equipment is currently located, in a specific implementation, the determining a direction of each of the multiple loudspeaker units relative to a listening subject may include: selecting a listening subject from the multiple listening subject as a reference object, and determining a direction of each of the multiple loudspeaker units relative to the reference object. Sound features of the listening subjects may be collected, and a listening subject whose sound feature matches a preset sound feature is determined as the reference object. Alternatively, facial features of the listening subject may be collected, and a listening subject whose facial feature matches a preset facial feature is determined as the reference object. In another specific implementation, the determining a direction of each of the multiple loudspeaker units relative to a listening subject may include: determining an enclosure area where all listening subjects are currently located, selecting a regional point from the enclosure area as a reference point, and determining a direction of each of the multiple loudspeaker units relative to the reference point. The enclosure area where all the listening subjects are currently located may be determined by image recognition, or determined according to positioning information collected by a positioning apparatus based on indoor positioning technology in a wearable intelligent device carried by each listening subject. In addition, the reference point may specifically be a central point of the enclosure area.

Step S32 includes determining a sound effect mode corresponding to the spatial distribution state.

Step S33 includes adjusting a sound effect of the sound equipment according to the sound effect mode.

For a more specific process of the steps S32 and S33, reference may be made to the corresponding content in the foregoing embodiments and the following embodiments, and details are not described herein.

Figure 9:
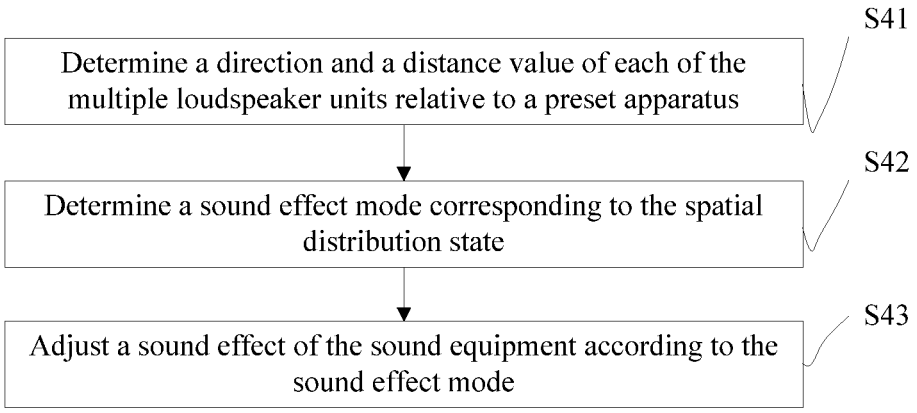
FIG. 9 is a flowchart of a specific sound effect adjustment method according to the present application.

Referring to FIG. 9, a sound effect adjustment method is provided according to the present application, which is applied to a sound equipment including multiple loudspeaker units, the method including steps S41 to S43.

Step S41 includes determining a direction and a distance value of each of the multiple loudspeaker units relative to a preset apparatus.

In the first specific implementation, multiple sound intensities corresponding to each of the multiple loudspeaker units may be determined through multiple microphones installed on the preset apparatus, and the direction and the distance value of each of the multiple loudspeaker units relative to the preset apparatus may be correspondingly determined according to the multiple sound intensities corresponding to each of the multiple loudspeaker units. That is, in the embodiment, multiple microphones may be preinstalled on the preset apparatus. In determining the direction and the distance value of each of the multiple loudspeaker units relative to the preset apparatus, different loudspeaker units are controlled to play a preset audio at different time instants, and the multiple sound intensities corresponding to each of the multiple loudspeaker units are collected through the multiple microphones when the loudspeaker unit plays the preset audio. Reference can be made to the corresponding description in the above embodiments for a detailed process of determining the direction of each of the multiple loudspeaker units relative to the preset apparatus according to the multiple sound intensities corresponding to each of the multiple loudspeaker units, which will not be repeated here. In addition, the process of determining the distance value of each of the multiple loudspeaker units relative to the preset apparatus may specifically include: calculating an average value of the multiple sound intensities corresponding to each of the multiple loudspeaker units, to obtain an average sound intensity corresponding to each of the multiple loudspeaker units, and determining the distance value of each of the multiple loudspeaker units relative to the preset apparatus according to a difference between the average sound intensity corresponding to each of the multiple loudspeaker units and a volume parameter of each of the multiple loudspeaker units when playing the preset audio. In the embodiment, each of the multiple loudspeaker units may be controlled to adopt a same volume parameter, before each of the multiple loudspeaker units plays the preset audio, that is, the multiple loudspeaker units play the preset audio at the same volume.

In the second specific implementation, image capturing is performed on a spatial environment in which the multiple loudspeaker units are located, with a third camera installed in the preset apparatus, to obtain a second panoramic image including depth information. An image region corresponding to each of the multiple loudspeaker units in the second panoramic image is identified to obtain multiple image regions including corresponding depth information, and the direction of each of the multiple loudspeaker units relative to the preset apparatus is determined according to the multiple image regions. It can be understood that the third camera in the embodiment is a panorama camera capable of collecting depth information.

In the third specific implementation, a positioning apparatus based on an indoor positioning technology built in each loudspeaker unit may be used to perform spatial positioning on each loudspeaker unit to obtain positioning information of each loudspeaker unit. A positioning apparatus based on an indoor positioning technology built in the preset apparatus may be used to perform spatial positioning on the preset apparatus to obtain positioning information of the preset apparatus. Subsequently, the direction and the distance value of each of the multiple loudspeaker units relative to the preset apparatus is determined according to the positioning information of the preset apparatus and the positioning information of each loudspeaker unit.

It can be understood that the above-described are only three specific implementations of the embodiment, rather than a limitation to the embodiment. In addition to the three specific implementations, other feasible solutions may also be adopted to determine the direction and the distance value of each of the multiple loudspeaker units relative to the listening subject, which are inconvenient to enumerate here.

Step S42 includes determining a sound effect mode corresponding to the spatial distribution state.

Step S43 includes adjusting a sound effect of the sound equipment according to the sound effect mode.

For a more specific process of the steps S42 and S43, reference may be made to the corresponding content in the foregoing embodiments and the following embodiments, and details are not described herein.

Figure 10:
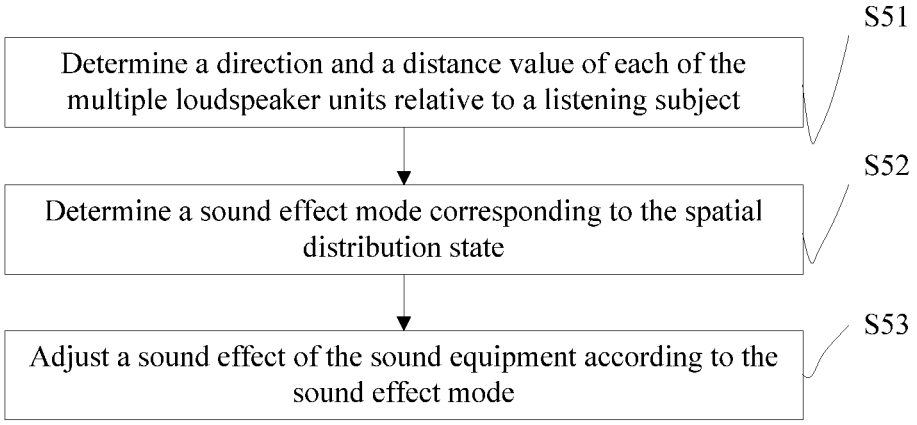
FIG. 10 is a flowchart of a specific sound effect adjustment method according to the present application.

Referring to FIG. 10, a sound effect adjustment method is provided according to the present application, which is applied to a sound equipment including multiple loudspeaker units, the method including steps S51 to S52.

Step S51 includes determining a direction and a distance value of each of the multiple loudspeaker units relative to a listening subject.

In the first specific implementation, a sound intensity corresponding to a sound made by a listening subject may be collected through multiple microphones preinstalled on each loudspeaker unit, to obtain multiple sound intensities corresponding to each of the multiple loudspeaker units, and the direction and the distance value of each of the multiple loudspeaker units relative to the listening subject may be correspondingly determined according to the multiple sound intensities corresponding to each of the multiple loudspeaker units. The direction of each of the multiple loudspeaker units relative to the listening subject may be determined by analyzing a difference between the multiple sound intensities corresponding to each of the multiple loudspeaker units. In addition, the process of determining the distance value of each of the multiple loudspeaker units relative to the listening subject specifically includes: calculating an average value of the multiple sound intensities corresponding to each of the multiple loudspeaker units, to obtain an average sound intensity corresponding to each of the multiple loudspeaker units, and comparing the average sound intensity corresponding to each of the multiple loudspeaker units with a real user sound intensity obtained based on empirical data or a real user sound intensity collected by an intelligent device carried on the user, to evaluate the distance value of each of the multiple loudspeaker units relative to the listening subject. It can be understood that the bigger the difference between the average sound intensity corresponding to each of the multiple loudspeaker units and the real user sound intensity, the bigger the distance value between the loudspeaker unit and the listening subject.

In the second specific implementation, a sound intensity corresponding to a sound made by the listening subject and a sound intensity corresponding to a sound made by each of the multiple loudspeaker units when playing a preset audio are collected through multiple microphones preinstalled on the preset apparatus, to obtain multiple sound intensities corresponding to each of the multiple loudspeaker units and multiple sound intensities corresponding to the listening subject. A direction and a distance value of each of the multiple loudspeaker units relative to the preset apparatus is determined through the multiple sound intensities corresponding to each of the multiple loudspeaker units. A direction and a distance value of the listening subject relative to the preset apparatus is determined through the multiple sound intensities corresponding to the listening subject. Finally, the direction and the distance value of each of the multiple loudspeaker units relative to the listening subject may be determined according to the direction and distance value of each of the multiple loudspeaker units relative to the preset apparatus and the direction and distance value of the listening subject relative to the preset apparatus.

In the third specific implementation, image capturing is performed on a spatial environment in which multiple loudspeaker units and the listening subject are located, with a fourth camera located above the sound equipment and the listening subject, to obtain a corresponding target image. An image region corresponding to each of the multiple loudspeaker units and an image region corresponding to the listening subject in the target image are identified, and the direction and the distance value of each of the multiple loudspeaker units relative to the listening subject are determined based on the image region corresponding to each of the multiple loudspeaker units and the image region corresponding to the listening subject.

In the fourth specific implementation, a positioning apparatus based on an indoor positioning technology built in each loudspeaker unit may be used to perform spatial positioning on each loudspeaker unit to obtain positioning information of each loudspeaker unit. A wearable intelligent device worn by the listening subject, which is based on an indoor positioning technology, may be used to perform spatial positioning on the listening subject to obtain positioning information of the listening subject. Subsequently, the direction and the distance value of each of the multiple loudspeaker units relative to the listening subject are determined based on the positioning information corresponding to each of the multiple loudspeaker units and the positioning information corresponding to the listening subject.

It can be understood that the above-described are only four specific implementations of the embodiment, rather than a limitation to the embodiment. In addition to the four specific implementations, other feasible solutions may also be adopted to determine the direction and the distance value of each of the multiple loudspeaker units relative to the listening subject, which are inconvenient to enumerate here.

In addition, it can be understood that, for each of the above specific implementations, the direction and the distance value of each loudspeaker unit relative to the listening subject may be determined based on coordinates of each loudspeaker unit in a coordinate system with a location of the listening subject as an origin thereof.

Step S52 includes determining a sound effect mode corresponding to the spatial distribution state.

Step S53 includes adjusting a sound effect of the sound equipment according to the sound effect mode.

For a more specific process of the steps S52 and S53, reference may be made to the corresponding content in the foregoing embodiments and the following embodiments, and details are not described herein.

Figure 11:
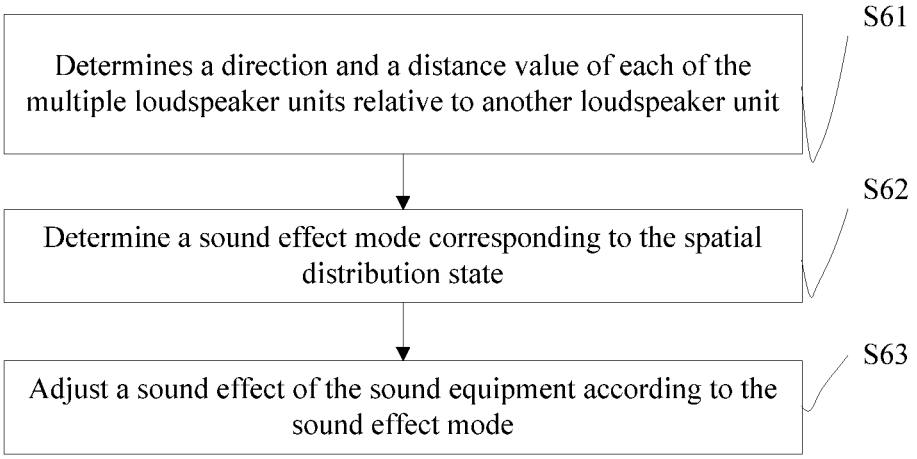
FIG. 11 is a flowchart of a specific sound effect adjustment method according to the present application.

Referring to FIG. 11, a sound effect adjustment method is provided according to the present application, which is applied to a sound equipment including multiple loudspeaker units, the method including steps S61 to S63.

Step S61 includes determining a direction and a distance value of each of the multiple loudspeaker units relative to another loudspeaker unit.

In the first specific implementation, a direction and a distance value of each of the multiple loudspeaker units relative to a preset apparatus may be determined first, and the direction and the distance value of each of the multiple loudspeaker units relative to another loudspeaker unit may be determined according to the direction and the distance value of each of the multiple loudspeaker units relative to the preset apparatus. In practice, in the embodiment, multiple microphones preinstalled on each loudspeaker units may collect multiple sound intensities corresponding to a sound made by the another loudspeaker unit, and the direction and the distance value of each of the multiple loudspeaker units relative to the another loudspeaker unit may be determined through the multiple sound intensities corresponding to the sound made by the another loudspeaker unit collected by each of the multiple loudspeaker units.

In the second specific implementation manner, image capturing is performed on a spatial environment in which the multiple loudspeaker units are located, with a fifth camera located above the sound equipment, to obtain a corresponding target image. An image region corresponding to each of the multiple loudspeaker units in the target image is identified, and the direction and the distance value of each of the multiple loudspeaker units relative to another loudspeaker unit is determined based on the image region corresponding to each of the multiple loudspeaker units.

In the third specific implementation, a positioning apparatus based on an indoor positioning technology built in each loudspeaker unit may be used to perform spatial positioning on each loudspeaker unit to obtain positioning information of each loudspeaker unit. Subsequently, the direction and the distance value of each of the multiple loudspeaker units relative to another loudspeaker unit are determined based on the positioning information corresponding to each of the multiple loudspeaker units.

It can be understood that the above-described are only three specific implementations of the embodiment, rather than a limitation to the embodiment. In addition to the three specific implementations, other feasible solutions may also be adopted to determine the direction and the distance value of each of the multiple loudspeaker units relative to another loudspeaker unit, which are inconvenient to enumerate here.

Step S62 includes determining a sound effect mode corresponding to the spatial distribution state.

Step S63 includes adjusting a sound effect of the sound equipment according to the sound effect mode.

For a more specific process of the steps S62 and S63, reference may be made to the corresponding content in the foregoing embodiments and the following embodiments, and details are not described herein.

Figure 12:
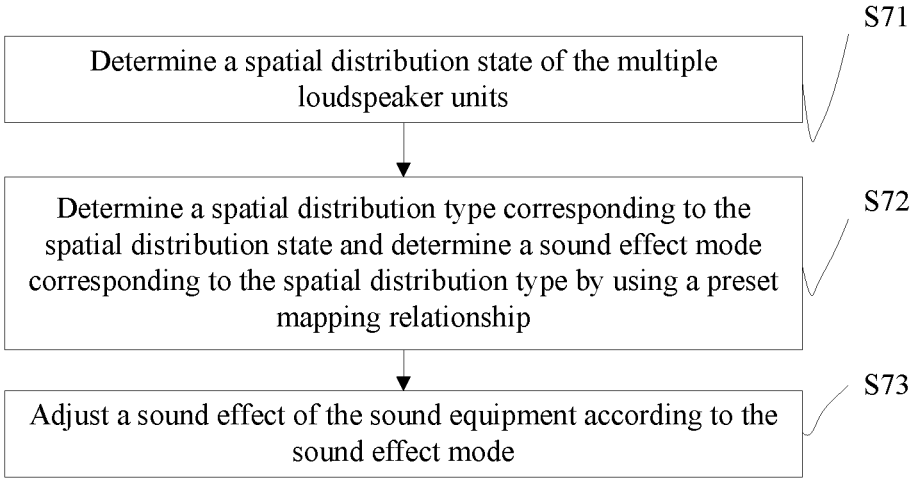
FIG. 12 is a flowchart of a specific sound effect adjustment method according to the present application.

Referring to FIG. 12, a sound effect adjustment method is provided according to the present application, which is applied to a sound equipment including multiple loudspeaker units, the method including steps S71 to S73.

Step S71 includes determining a spatial distribution state of the multiple loudspeaker units.

For a detailed process of the step S71, reference may be made to the corresponding content in the foregoing embodiments, which will not be repeated herein.

Step S72 includes determining a spatial distribution type corresponding to the spatial distribution state and determining a sound effect mode corresponding to the spatial distribution type by using a preset mapping relationship.

That is, in the embodiment, several different sound effect modes may be preset, and a mapping relationship between different sound effect modes and different spatial distribution types may be created. In this way, when the spatial distribution type corresponding to the spatial distribution state is determined subsequently, the sound effect mode corresponding to the spatial distribution type may be determined directly from the mapping relationship. The process of determining a sound effect mode according to a mapping relationship is relatively simple without complicated calculations.

Figure 13:
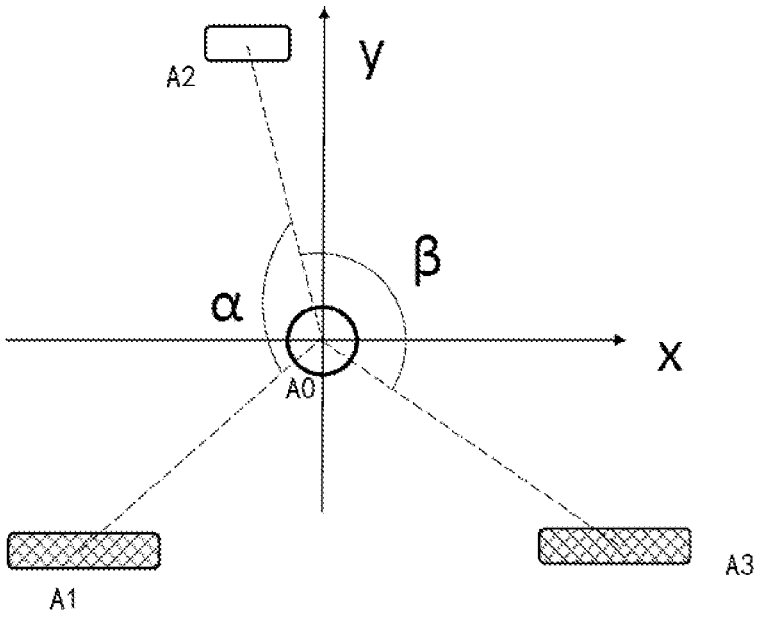
FIG. 13 is a schematic diagram of an angle between loudspeaker units and a control unit according to the present application.

In a specific implementation, the spatial distribution type corresponding to the spatial distribution state may be determined according to a direction in the spatial distribution state, and the sound effect mode corresponding to the spatial distribution type may be determined through a first preset mapping relationship. That is, in the embodiment, the spatial distribution type corresponding to the spatial distribution state may be determined based on direction information in the spatial distribution state. Specifically, an angle between each two loudspeaker units relative to another loudspeaker unit may be determined according to the direction of each loudspeaker unit relative to the another loudspeaker unit, and the corresponding spatial distribution type may be determined according to an angle range to which the angle belongs. In addition, an angle of different loudspeaker units relative to the preset apparatus may be determined according to a direction of each loudspeaker unit relative to the preset apparatus, and the corresponding spatial distribution type may be determined according to an angle range to which the angle belongs. For example, referring to FIG. 13, an angle $\alpha$ between the loudspeaker units A1 and A2 relative to the control unit A0 and an angle $\beta$ between the loudspeaker units A2 and A3 relative to the control unit A0 are determined, and a corresponding spatial distribution type may be determined based on angle ranges to which the angles $\alpha$ and $\beta$ belong. Further, an angle between different loudspeaker units relative to a listening subject may be determined according to the direction of each loudspeaker unit relative to the listening subject, and a corresponding spatial distribution type may be determined according to a range to which the angle belongs. It can be understood that the first preset mapping relationship refers to a pre-saved mapping relationship between spatial distribution types, obtained based on directions in spatial distribution states, and sound effect modes.

In another specific implementation, the spatial distribution type corresponding to the spatial distribution state may be determined according to a direction and a distance value in the spatial distribution state, and the sound effect mode corresponding to the spatial distribution type may be determined through a second preset mapping relationship. That is, in the embodiment, the spatial distribution type corresponding to the spatial distribution state may be determined based on the direction and the distance value in the spatial distribution state. Specifically, a size of a space region enclosed by the multiple loudspeaker units may be determined according to a direction and a distance value of each of the loudspeaker units relative to another loudspeaker unit, and a corresponding spatial distribution type may be determined according a space region size range to which the size of the space region belongs. In addition, a size of a space region enclosed by the multiple loudspeaker units and the preset apparatus may be determined according to a direction and a distance value of each of the loudspeaker units relative to the preset apparatus, and a corresponding spatial distribution type may be determined according a space region size range to which the size of the space region belongs. Further, a size of a space region enclosed by the multiple loudspeaker units and the listening subject may also be determined according to a direction and a distance value of each of the loudspeaker units relative to the listening subject, and a corresponding spatial distribution type may be determined according a space region size range to which the size of the space region belongs. It can be understood that the second preset mapping relationship refers to a pre-saved mapping relationship between spatial distribution types, obtained based on directions and distance values in spatial distribution states, and sound effect modes.

Step S73 includes adjusting a sound effect of the sound equipment according to the sound effect mode.

For a more specific process of the step S73, reference may be made to the corresponding content in the foregoing embodiments and the following embodiments, and details are not described herein.

Figure 14:
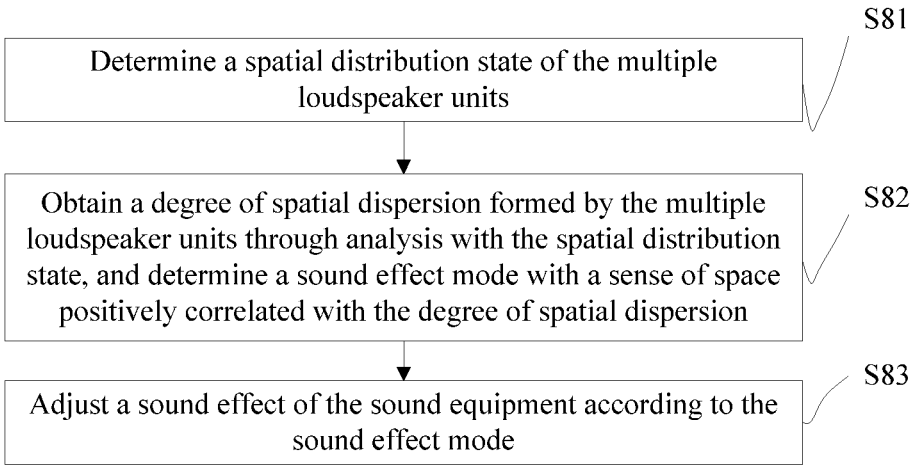
FIG. 14 is a flowchart of a specific sound effect adjustment method according to the present application.

Referring to FIG. 14, a sound effect adjustment method is provided according to the present application, which is applied to a sound equipment including multiple loudspeaker units, the method including step S81 to S83.

Step S81 includes determining a spatial distribution state of the multiple loudspeaker units For a detailed process of the step S81, reference may be made to the corresponding content in the foregoing embodiments, which will not be repeated herein.

Step S82 includes obtaining a degree of spatial dispersion formed by the multiple loudspeaker units through analysis with the spatial distribution state and determining a sound effect mode with a sense of space that is positively correlated with the degree of spatial dispersion.

That is, in the embodiment, after the degree of spatial dispersion formed by the multiple loudspeaker units is obtained through the analysis, a sense of space of sound effect positively correlated with the degree of spatial dispersion is determined by real-time calculation, and a corresponding sound effect mode is determined based on the sense of space of sound effect.

In a specific implementation, the degree of spatial dispersion formed by the multiple loudspeaker units may be obtained through analysis with a direction in the spatial distribution state, and a sound effect mode with a sense of space positively correlated with the degree of spatial dispersion may be determined. That is, in the embodiment, the degree of spatial dispersion formed by the multiple loudspeaker units may be determined based on direction information in the spatial distribution state. Specifically, an angle between each two loudspeaker units relative to another loudspeaker unit may be determined according to a direction of each loudspeaker unit relative to the another loudspeaker unit, and the degree of spatial dispersion may be obtained through analysis with the angle. In addition, an angle of different loudspeaker units relative to a preset apparatus may be determined according to a direction of each loudspeaker unit relative to the preset apparatus, and the degree of spatial dispersion may be obtained through analysis with the angle. For example, referring to FIG. 13, an angle $\alpha$ between the loudspeaker units A1 and A2 relative to the control unit A0 and an angle $\beta$ between the loudspeaker units A2 and A3 relative to the control unit A0 are determined, and the degree of spatial dispersion formed by the multiple loudspeaker units may be obtained through analysis with the angle $\alpha$ and $\beta$. Further, an angle between different loudspeaker units relative to a listening subject may be determined according to the direction of each loudspeaker unit relative to the listening subject, and the degree of spatial dispersion formed by the multiple loudspeaker units may be obtained through analysis with the angle.

In another specific implementation, the degree of spatial dispersion formed by the multiple loudspeaker units may be obtained through analysis with a direction and a distance value in the spatial distribution state, and a sound effect mode with a sense of space positively correlated with the degree of spatial dispersion may be determined. That is, in the embodiment, the degree of spatial dispersion formed by the multiple loudspeaker units may be determined based on the direction and the distance value in the spatial distribution state. Specifically, a size of a space region enclosed by the multiple loudspeaker units may be determined according to a direction and a distance value of each of the multiple loudspeaker units relative to another loudspeaker unit, and the degree of spatial dispersion formed by the multiple loudspeaker units may be obtained through analysis with the size of the space region. In addition, a size of a space region enclosed by the multiple loudspeaker units and a preset apparatus may also be determined according to a direction and a distance value of each of the multiple loudspeaker units relative to the preset apparatus, and the degree of spatial dispersion formed by the multiple loudspeaker units may be obtained through analysis with the size of the space region. Further, a size of a space region enclosed by the multiple loudspeaker units and a listening subject may be determined according to a direction and a distance value of each of the multiple loudspeaker units relative to the listening subject, and the degree of spatial dispersion formed by the multiple loudspeaker units may be obtained through analysis with the size of the space region.

Step S83 includes adjusting a sound effect of the sound equipment according to the sound effect mode.

For a more specific process of the step S83, reference may be made to the corresponding content in the foregoing embodiments and the following embodiments, and details are not described herein.

Figure 15:
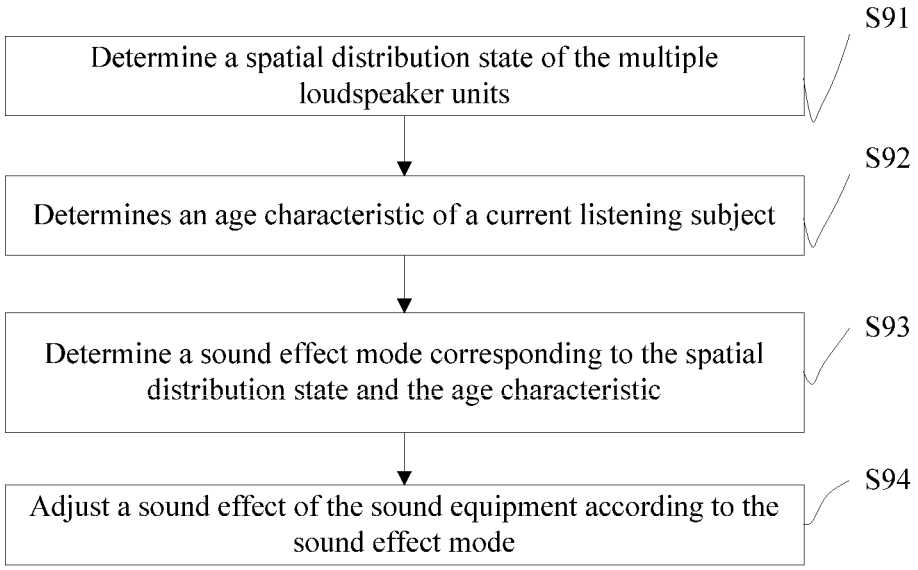
FIG. 15 is a flowchart of a specific sound effect adjustment method according to the present application.

Referring to FIG. 15, a sound effect adjustment method is provided according to the present application, which is applied to a sound equipment including multiple loudspeaker units, the method including steps S91 to S94.

Step S91 includes determining a spatial distribution state of the multiple loudspeaker units.

For a detailed process of the step S91, reference may be made to the corresponding content in the foregoing embodiments, which will not be repeated herein.

Step S92 includes determining an age characteristic of a current listening subject.

Specifically, considering that listening subjects at different ages such as children, young people, middle-aged people, and the elderly have different voice features and facial features, an age characteristic of a listening subject may be obtained by collecting and analyzing a voice feature and/or a facial feature of the listening subject.

Step S93 includes determining a sound effect mode corresponding to the spatial distribution state and the age characteristic.

In a specific implementation, all sound effect modes corresponding to the spatial distribution state may be determined first, and a sound effect mode matching the age characteristic may be selected from all the determined sound effect modes, so as to ensure the final selected sound effect mode can meet preferences of users of the corresponding age group for sound effects.

In another specific implementation, all sound effect modes corresponding to the age characteristic may be determined first, and a sound effect mode matching the spatial distribution state may be selected from all the determined sound effect modes.

It can be seen from the above that, the embodiment takes into account the differences in preferences of listening subjects of different age characteristics for sound effects, and a sound effect mode may be determined based on the spatial distribution state and the age characteristic. In practice, considering that there are certain differences between the preferences of listening subjects of different genders for sound effects, a gender characteristic of a listening subject may also be identified in the embodiment, and a sound effect mode may be determined based on the spatial distribution state and the gender characteristic of the listening subject, or a sound effect mode may be determined based on the spatial distribution state, the age characteristic and the gender characteristic of the listening subject. In the embodiment, the gender characteristic may be obtained by collecting and analyzing the voice feature and/or the facial feature of the listening subject.

Step S94 includes adjusting a sound effect of the sound equipment according to the sound effect mode.

For a more specific process of the step S94, reference may be made to the corresponding content in the foregoing embodiments and the following embodiments, and details are not described herein.

Figure 16:
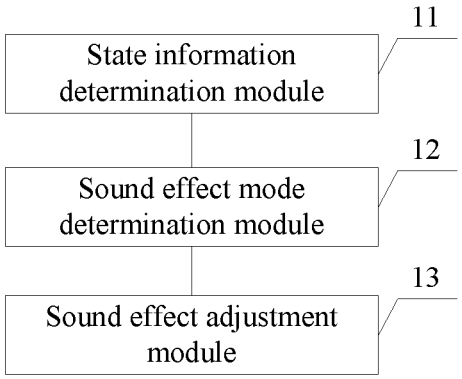
FIG. 16 is a schematic structural diagram of a sound effect adjustment apparatus according to the present application.

Referring to FIG. 16, a sound effect adjustment apparatus is provided according to the present application, which is applied to a sound equipment including multiple loudspeaker units, the apparatus including:

a state information determination module 11 configured to determine a spatial distribution state of the multiple loudspeaker units;

a sound effect mode determination module 12 configured to determine a sound effect mode corresponding to the spatial distribution state; and a sound effect adjustment module 13 configured to adjust a sound effect of the sound equipment according to the sound effect mode.

For a more specific working process of each of the modules, reference may be made to corresponding content in the above embodiments, which will not be repeated herein.

It can be seen that the sound effect adjustment solution of the present application is applied to a sound equipment including multiple loudspeaker units. A spatial distribution state of the multiple loudspeaker units is determined first, a sound effect mode corresponding to the spatial distribution state is subsequently determined, and the sound equipment is adjusted afterwards according to the sound effect mode. That is, in the embodiment of the present application, the sound effect mode may be correspondingly adjusted according to the spatial distribution state of the multiple loudspeaker units in the sound equipment. In this way, when the spatial distribution state changes, the sound effect mode of the sound equipment may also be changed accordingly, which overcomes the disadvantage of monotonous sound effect of sound equipment. In summary, the embodiment of the present application can effectively increase the diversity of sound effects of sound equipment.

Figure 17:
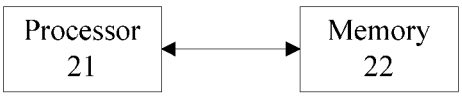
FIG. 17 is a structural diagram of a sound effect adjustment device according to the present application.

Further, a sound effect adjustment device is further provided according to an embodiment of the present application. As shown in FIG. 17, the sound effect adjustment device includes a processor 21 and a memory 22, where:

the memory 22 is configured to store a computer program;

the processor 21 is configured to execute the computer program to perform the following steps:

determining a spatial distribution state of the multiple loudspeaker units; determining a sound effect mode corresponding to the spatial distribution state; and adjusting a sound effect of the sound equipment according to the sound effect mode.

It can be seen that the sound effect adjustment solution of the present application is applied to a sound equipment including multiple loudspeaker units. A spatial distribution state of the multiple loudspeaker units is determined first, a sound effect mode corresponding to the spatial distribution state is subsequently determined, and the sound equipment is adjusted afterwards according to the sound effect mode. That is, in the embodiment of the present application, the sound effect mode may be correspondingly adjusted according to the spatial distribution state of the multiple loudspeaker units in the sound equipment. In this way, when the spatial distribution state changes, the sound effect mode of the sound equipment may also be changed accordingly, which overcomes the disadvantage of monotonous sound effect of sound equipment. In summary, the embodiment of the present application can effectively increase the diversity of sound effects of sound equipment.

In the embodiment, the processor 21 may perform the following step when executing a computer subprogram stored in the memory 22: determining a direction of each loudspeaker unit relative to a preset apparatus.

In the embodiment, the processor 21 may perform the following step when executing a computer subprogram stored in the memory 22: determining a direction of each loudspeaker unit relative to a listening subject.

In the embodiment, the processor 21 may perform the following step when executing a computer subprogram stored in the memory 22: determining a direction and a distance value of each loudspeaker unit relative to a preset apparatus.

In the embodiment, the processor 21 may perform the following step when executing a computer subprogram stored in the memory 22: determining a direction and a distance value of each loudspeaker unit relative to a listening subject.

In the embodiment, the processor 21 may perform the following step when executing a computer subprogram stored in the memory 22: determining a direction and a distance value of each loudspeaker unit relative to another loudspeaker unit.

In the embodiment, the processor 21 may perform the following step when executing a computer subprogram stored in the memory 22: determining the spatial distribution state of the multiple loudspeaker units with a sound intensity collected by a microphone.

In the embodiment, the processor 21 may perform the following step when executing a computer subprogram stored in the memory 22: determining the spatial distribution state of the multiple loudspeaker units with image information collected by a camera.

In the embodiment, the processor 21 may perform the following step when executing a computer subprogram stored in the memory 22: determining the spatial distribution state of the multiple loudspeaker units with positioning information collected by a positioning apparatus based on an indoor positioning technology.

In the embodiment, the processor 21 may perform the following steps when executing a computer subprogram stored in the memory 22: determining a spatial distribution type corresponding to the spatial distribution state according to a direction in the spatial distribution state; and determining a sound effect mode corresponding to the spatial distribution type by using a first preset mapping relationship.

In the embodiment, the processor 21 may perform the following steps when executing a computer subprogram stored in the memory 22: determining a spatial distribution type corresponding to the spatial distribution state according to a direction and a distance value in the spatial distribution state; and determining a sound effect mode corresponding to the spatial distribution type by using a second preset mapping relationship.

In the embodiment, the processor 21 may perform the following steps when executing a computer subprogram stored in the memory 22: obtaining a degree of spatial dispersion formed by the multiple loudspeaker units, through analysis with a direction in the spatial distribution state; and determining a sound effect mode with a sense of space that is positively correlated with the degree of spatial dispersion.

In the embodiment, the processor 21 may perform the following steps when executing a computer subprogram stored in the memory 22: obtaining a degree of spatial dispersion formed by the multiple loudspeaker units, through analysis with a direction and a distance value in the spatial distribution state; and determining a sound effect mode with a sense of space that is positively correlated with the degree of spatial dispersion.

In the embodiment, the processor 21 may perform the following step when executing a computer subprogram stored in the memory 22: adjusting, automatically and directly, the sound effect of the sound equipment according to the sound effect mode.

In the embodiment, the processor 21 may perform the following step when executing a computer subprogram stored in the memory 22: monitoring whether an adjustment instruction sent by a preset client is obtained, and if an adjustment instruction sent by the preset client is obtained, adjusting the sound effect of the sound equipment according to the sound effect mode.

Figure 18:
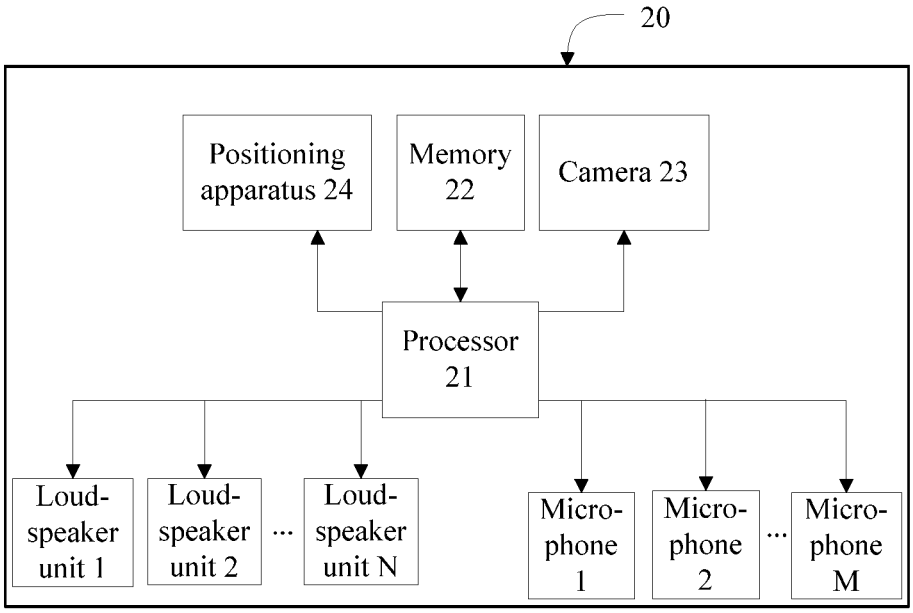
FIG. 18 is a structural diagram of a sound equipment according to the present application.

Further, referring to FIG. 18, a sound equipment 20 is further provided according to an embodiment of the present application, including multiple loudspeaker units, and further including the sound effect adjustment device according to the above embodiments.

For a specific structure of the above sound effect adjustment device, reference may be made to the corresponding content in the above embodiments, which will not be repeated herein.

In addition, the sound equipment 20 may further include:

multiple microphones configured to collect sound intensities; and/or, a camera 23 configured to collect image information; and/or, a positioning apparatus 24 configured to perform positioning based on an indoor positioning technology.

In some embodiments, the multiple microphones may be specifically installed on a preset apparatus, for example, on the sound effect adjustment device.

In some embodiments, the multiple microphones may be specifically installed on each loudspeaker unit.

The multiple microphones are evenly arranged in space, and can form a ring structure, thereby obtaining a microphone ring array.

In some embodiments, the camera 23 may be a panoramic camera.

In some embodiments, the camera 23 is not only a panoramic camera, but also is capable of collecting depth information.

In some embodiments, the camera 23 may be a traditional photographing camera.

Further, the positioning apparatus 24 includes, but is not limited to, a WiFi indoor positioning apparatus, a Bluetooth indoor positioning apparatus, an ultra-wideband indoor positioning apparatus, and a ZigBee indoor positioning apparatus.

Further, the sound effect adjustment device is also provided with a connection component and can be combined and connected with a loudspeaker unit by the connection component to form an integrated portable structure.

In some embodiments, a connection component may be provided at only one end of the sound effect adjustment device, and the connection component may be configured to combine and connect the sound effect adjustment device with any loudspeaker unit.

In some embodiments, two connection components may be provided at two ends of the sound effect adjusting device respectively, and the two connection components may be configured to combine and connect the sound effect adjustment device with two loudspeaker units.

In some embodiments, the connection component is specifically combined and connected with a loudspeaker unit by means of magnetic attraction.

In some embodiments, the connection component is specifically combined and connected with a loudspeaker unit by means of snap-fit connection.

Further, a computer-readable storage medium is further provided according to an embodiment of the present application, which is configured to store a computer program, where the computer program is executable by a processor to perform the sound effect adjustment methods as described in the foregoing embodiments.

For a specific process of the above sound effect adjustment methods, reference may be made to the corresponding content in the foregoing embodiments, which will not be repeated herein.

The various embodiments are described in a progressive manner. Each of the embodiments is mainly focused on describing its differences from other embodiments, and reference may be made among these embodiments with respect to the same or similar parts. For the apparatus disclosed in the embodiment, since it corresponds to the method disclosed in the embodiment, the description is relatively simple, and the relevant part may refer to the description of the method part.

The steps of the method or algorithm described in the embodiments disclosed herein can be directly implemented by hardware, software module executed by a processor, or a combination of the two. The software module may be placed in a random access memory (RAM), an internal memory, a read-only memory (ROM), an electrically programmable ROM, an electrically erasable programmable ROM, a register, a hard disk, a portable hard disk, a CD-ROM, or any other known storage media in the technical field.

A sound equipment and a method, an apparatus, a device for adjusting a sound effect thereof, and a medium are described in detail according to the present application. Specific examples are used herein to illustrate the principle and implementation of the present application. The description of the above embodiments is only used to help understanding the method and core idea of the present application; also, for those of ordinary skill in the art, there will be changes in the specific implementation and scope of application according to the idea of the present application. In summary, the content of the description should not be construed as a limitation on the present application.

The various embodiments are described in a progressive manner or a parallel manner. Each of the embodiments is mainly focused on describing its differences from other embodiments, and reference may be made among these embodiments with respect to the same or similar parts. For the apparatus disclosed in the embodiment, since it corresponds to the method disclosed in the embodiment, the description is relatively simple, and the relevant part may refer to the description of the method part.

Those of ordinary skill in the art may also understand that, units of various examples and steps of an algorithm described in combination with the embodiments disclosed herein, can be implemented by electronic hardware, computer software, or a combination of the two, in order to clearly illustrate the interchangeability of the hardware and software, components and steps of each example have been generally described in accordance with the function in the above description. Whether these functions are executed by hardware or software depends on the specific application and design constraint conditions of the technical solution. Professionals may use different methods for each specific application to implement the described functions, but such implementation should not be considered beyond the scope of the present application.

It is noted that in the context of this disclosure, the direction and the distance value of a first entity (for example, the loudspeaker unit, the preset apparatus and the listening subject) relative to a second entity (for example, the loudspeaker unit, the preset apparatus and the listening subject) may respectively refer to a direction and a distance value from the second entity to the first entity or the other way around. It should also be noted that, relation terms such as first and second are only used to distinguish one entity or operation from another entity or operation, and do not necessarily require or imply that there is an actual relationship or order between these entities or operations. Moreover, the terms "include", "contain" or any other variants thereof are intended to cover non-exclusive inclusion, so that a process, a method, an article or a device including a series of elements not only includes those elements, but also includes other elements that are not explicitly listed, or also includes elements that are inherent in the process, the method, the article or the device. In a case of no more restrictions, the element defined by phrase "including" does not exclude the existence of other identical elements in the process, the method, the article, or the device.

The invention claimed is:

1. A sound effect adjustment method, applied to a sound equipment comprising a plurality of loudspeaker units, the method comprising:

determining a spatial distribution state of the plurality of loudspeaker units;

determining a sound effect mode corresponding to the spatial distribution state; and adjusting a sound effect of the sound equipment according to the sound effect mode, wherein the method further comprises:

presetting a sliding control rule, wherein the sliding control rule comprises a sliding trigger time and a preset spatial distribution state; and controlling, at the sliding trigger time, the loudspeaker units to slide on preset slide rails, so that the multiple loudspeaker units form the preset spatial distribution state.

2. The sound effect adjustment method according to claim 1, wherein the determining a spatial distribution state of the plurality of loudspeaker units further comprises:

determining a direction of each of the plurality of loudspeaker units relative to a preset apparatus; or determining a direction of each of the plurality of loudspeaker units relative to a listening subject.

3. The sound effect adjustment method according to claim 2, wherein the determining a sound effect mode corresponding to the spatial distribution state comprises:

determining a spatial distribution type corresponding to the spatial distribution state according to a direction in the spatial distribution state; and determining a sound effect mode corresponding to the spatial distribution type by using a first preset mapping relationship.

4. The sound effect adjustment method according to claim 2, wherein the determining a sound effect mode corresponding to the spatial distribution state comprises:

obtaining a degree of spatial dispersion formed by the plurality of loudspeaker units, through analysis with a direction in the spatial distribution state; and determining a sound effect mode with a sense of space that is positively correlated with the degree of spatial dispersion.

5. The sound effect adjustment method according to claim 2, wherein the determining a spatial distribution state of the plurality of loudspeaker units comprises:

determining the spatial distribution state of the plurality of loudspeaker units with a sound intensity collected by a microphone;

determining the spatial distribution state of the plurality of loudspeaker units with image information collected by a camera; or determining the spatial distribution state of the plurality of loudspeaker units with positioning information collected by a positioning apparatus based on an indoor positioning technology.

6. The sound effect adjustment method according to claim 2, wherein the adjusting a sound effect of the sound equipment according to the sound effect mode comprises:

adjusting, automatically and directly, the sound effect of the sound equipment according to the sound effect mode; or monitoring whether an adjustment instruction sent by a preset client is obtained, and in a case that an adjustment instruction sent by the preset client is obtained, adjusting the sound effect of the sound equipment according to the sound effect mode.

7. The sound effect adjustment method according to claim 1, wherein the determining a spatial distribution state of the plurality of loudspeaker units further comprises:

determining a direction and a distance value of each of the plurality of loudspeaker units relative to a preset apparatus;

determining a direction and a distance value of each of the plurality of loudspeaker units relative to a listening subject; or determining a direction and a distance value of each of the plurality of loudspeaker units relative to another loudspeaker unit.

8. The sound effect adjustment method according to claim 7, wherein the determining a sound effect mode corresponding to the spatial distribution state comprises:

determining a spatial distribution type corresponding to the spatial distribution state according to a direction and a distance value in the spatial distribution state; and determining a sound effect mode corresponding to the spatial distribution type by using a second preset mapping relationship.

9. The sound effect adjustment method according to claim 7, wherein the determining a sound effect mode corresponding to the spatial distribution state comprises:

obtaining a degree of spatial dispersion formed by the plurality of loudspeaker units, through analysis with a direction and a distance value in the spatial distribution state; and determining a sound effect mode with a sense of space that is positively correlated with the degree of spatial dispersion.

10. The sound effect adjustment method according to claim 7, wherein the determining a spatial distribution state of the plurality of loudspeaker units comprises:

determining the spatial distribution state of the plurality of loudspeaker units with a sound intensity collected by a microphone;

determining the spatial distribution state of the plurality of loudspeaker units with image information collected by a camera; or determining the spatial distribution state of the plurality of loudspeaker units with positioning information collected by a positioning apparatus based on an indoor positioning technology.

11. The sound effect adjustment method according to claim 7, wherein the determining a sound effect mode corresponding to the spatial distribution state comprises:

determining a spatial distribution type corresponding to the spatial distribution state according to a direction in the spatial distribution state; and determining a sound effect mode corresponding to the spatial distribution type by using a first preset mapping relationship.

12. The sound effect adjustment method according to claim 7, wherein the determining a sound effect mode corresponding to the spatial distribution state comprises:

obtaining a degree of spatial dispersion formed by the plurality of loudspeaker units, through analysis with a direction in the spatial distribution state; and determining a sound effect mode with a sense of space that is positively correlated with the degree of spatial dispersion.

13. The sound effect adjustment method according to claim 7, wherein the adjusting a sound effect of the sound equipment according to the sound effect mode comprises:

adjusting, automatically and directly, the sound effect of the sound equipment according to the sound effect mode; or monitoring whether an adjustment instruction sent by a preset client is obtained, and in a case that an adjustment instruction sent by the preset client is obtained, adjusting the sound effect of the sound equipment according to the sound effect mode.

14. The sound effect adjustment method according to claim 1, wherein the determining a spatial distribution state of the plurality of loudspeaker units further comprises:

determining the spatial distribution state of the plurality of loudspeaker units with a sound intensity collected by a microphone;

determining the spatial distribution state of the plurality of loudspeaker units with image information collected by a camera; or determining the spatial distribution state of the plurality of loudspeaker units with positioning information collected by a positioning apparatus based on an indoor positioning technology.

15. The sound effect adjustment method according to claim 1, wherein the adjusting a sound effect of the sound equipment according to the sound effect mode comprises:

adjusting, automatically and directly, the sound effect of the sound equipment according to the sound effect mode; or monitoring whether an adjustment instruction sent by a preset client is obtained, and in a case that an adjustment instruction sent by the preset client is obtained, adjusting the sound effect of the sound equipment according to the sound effect mode.

16. A non-transitory computer-readable storage medium having a computer program stored thereon, wherein the computer program is executable by a processor to perform the sound effect adjustment method according to claim 1.

17. A sound effect adjustment device, applied to a sound equipment comprising a plurality of loudspeaker units, the sound effect adjustment device comprising:

a memory configured to store a computer program; and a processor configured to execute the computer program to perform:

determining a spatial distribution state of the plurality of loudspeaker units;

determining a sound effect mode corresponding to the spatial distribution state; and adjusting a sound effect of the sound equipment according to the sound effect mode, wherein the processor is further configured to execute the computer program to perform:

presetting a sliding control rule, wherein the sliding control rule comprises a sliding trigger time and a preset spatial distribution state; and controlling, at the sliding trigger time, the loudspeaker units to slide on preset slide rails, so that the multiple loudspeaker units form the preset spatial distribution state.

18. A sound equipment, comprising a plurality of loudspeaker units, and further comprising the sound effect adjustment device according to claim 17.

19. The sound equipment according to claim 18, further comprising:

a plurality of microphones configured to collect sound intensities;

a camera configured to collect image information; and/or a positioning apparatus configured to perform positioning based on an indoor positioning technology.

* * * * *